United States Patent [19]

Plasko

[11] 4,314,224

[45] Feb. 2, 1982

[54] THERMALLY ACTUATABLE ELECTRICAL SWITCH CONSTRUCTION AND METHOD OF MAKING THE SAME

[75] Inventor: Emil R. Plasko, Washington Township, Montgomery County, Ohio

[73] Assignee: Emerson Electric Company, St. Louis, Mo.

[21] Appl. No.: 108,545

[22] Filed: Dec. 31, 1979

[51] Int. Cl.[3] ..... H01H 37/76

[52] U.S. Cl. ..... 337/408; 337/409

[58] Field of Search ..... 337/407, 408, 409, 401–405

[56] References Cited

U.S. PATENT DOCUMENTS

| | | | |
|---|---|---|---|
| 3,821,685 | 6/1974 | Kimball et al. | 337/409 |
| 3,827,014 | 7/1974 | Wehl | 337/407 |
| 4,167,724 | 9/1979 | McCaughna | 337/408 |
| 4,184,139 | 1/1980 | Hana | 337/407 |
| 4,276,531 | 6/1981 | Davis | 337/407 |
| 4,281,308 | 7/1981 | McVey | 337/409 |
| 4,281,309 | 7/1981 | Olson | 337/407 |

FOREIGN PATENT DOCUMENTS

| | | | |
|---|---|---|---|
| 2853321 | 6/1979 | Fed. Rep. of Germany | 337/407 |

*Primary Examiner*—George Harris

*Attorney, Agent, or Firm*—Candor, Candor & Tassone

[57] ABSTRACT

A thermally actuatable electrical switch construction having a resilient contact member normally biased into electrical contact with a stationary contact member while a temperature sensitive member of the construction is in a solid condition and normally tending to spring out of contact with the stationary contact member by the natural bias of the resilient contact member when the temperature sensitive member is rendered non-solid by sensing a temperature above a predetermined temperature. The construction carries a guide member operatively associated with the resilient contact member to provide a guide for the resilient contact member that will substantially insure that the resilient contact member will move and be maintained out of contact with the stationary contact member after the temperature sensitive member has been rendered non-solid. The guide member comprises a spring engaging and acting on the resilient contact member to tend to pull the resilient contact member out of contact with the stationary contact member.

34 Claims, 7 Drawing Figures

THERMALLY ACTUATABLE ELECTRICAL SWITCH CONSTRUCTION AND METHOD OF MAKING THE SAME

BACKGROUND OF THE INVENTION

1. Field of the Invention

This invention relates to an improved thermally actuatable electrical switch construction and to a method of making the same.

2. Prior Art Statement

It is known to provide a thermally actuatable electrical switch construction having a resilient contact member normally biased into electrical contact with a stationary contact member while a temperature sensitive member of the construction is in a solid condition and normally springing out of contact with the stationary contact member by the natural bias of the resilient contact member when the temperature sensitive member is rendered non-solid by sensing a temperature above a predetermined temperature.

For example, see the following item:

(1) U.S. Pat. No. 3,827,014—Wehl

It is also known to provide such a thermally actuatable electrical switch construction wherein the resilient contact member can comprise a hollow body carried by the insulated terminal and be radially expanded outwardly into electrical contact with a conductive casing side wall by the solid temperature sensing member and spring radially inwardly out of contact with the casing side wall when the temperature sensitive member is rendered non-solid.

For example, see the following three items:

(2) U.S. Pat. No. 4,167,724—McCaughna (3) German Pat. No. 2,837,827—Hara (4) U.S. Pat. No. 4,184,139—Hara It is also known to applicant to provide a guide means that is carried by the thermally actuatable electrical switch construction and is operatively associated with the resilient contact member to provide a guide for the resilient contact member that will substantially insure that the resilient contact member will move and be maintained out of contact with a stationary contact member of the construction after the temperature sensitive member has been rendered non-solid, the guide means comprising a cup-shaped member which will telescope over the resilient contact member under the force of a compression spring when the temperature sensitive member has been rendered non-solid.

For example, see the following item:

(5) Ser. No. 085,216, filed Oct. 16, 1979—Candor.

The compression spring of item (4) above does not engage the resilient contact member and, in effect, pushes the resilient contact member out of contact with the stationary contact member when the temperature sensitive member has been rendered non-solid.

There are other prior known thermally actuatable electrical switch constructions wherein a compression spring, in effect, pushes the resilient contact member out of contact with the stationary contact member in a manner to actually deform the resilient contact member away from the stationary contact member.

For example, see the following four items:

(5) U.S. Pat. No. 3,930,215—Senor (6) U.S. Pat. No. 3,944,960—Audette et al (7) U.S. Pat. No. 4,109,229—Plasko (8) German Pat. No. 2,911,950—Olson et al.

SUMMARY OF THE INVENTION

It is a feature of this invention to provide an improved thermally actuatable electrical switch construction that has a resilient contact member normally biased into electrical contact with a stationary contact member while a temperature sensitive member of the construction is in a solid condition and normally springing out of contact with the stationary contact member by the natural bias of the resilient contact member when the temperature sensitive member is rendered non-solid by sensing a temperature above the predetermined temperature.

In particular, it is believed according to the teachings of the invention set forth in the aforementioned copending application of another applicant, Ser. No. 085,216, filed Oct. 16, 1979, that a guide means can be provided in such a thermally actuatable electrical switch construction to always insure that the resilient contact member will move and be maintained out of contact with the stationary contact member after the temperature sensitive member has been rendered non-solid.

For example, in one embodiment of the invention set forth in that copending application, Ser. No. 085,216, filed Oct. 16, 1979, the guide means comprises a spring loaded cup-shaped insulating member which will telescope over the resilient contact member after the temperature sensitive member is rendered non-solid so that if the natural bias of the resilient contact member does not pull the resilient contact means out of contact with the stationary contact member, the cup-shaped member will wedge between the resilient contact member and the stationary contact member to provide and maintain an insulated barrier therebetween.

However, according to the teaching of this invention, it is believed that a simple compression spring can be arranged to engage and act directly on the resilient contact member to tend to pull the resilient contact member out of contact with the stationary contact member so that when the temperature sensitive member has been rendered non-solid, the spring will substantially insure that the resilient contact member will move and be maintained out of contact with the stationary contact member.

Accordingly, one embodiment of this invention provides a thermally actuatable electrical switch construction having a resilient contact member normally biased into electrical contact with the stationary contact member while a temperature sensitive member of the construction is in a solid condition and normally tending to spring out of contact with the stationary contact member by the natural bias of the resilient contact member when the temperature sensitive member is rendered non-solid by sensing a temperature above a predetermined temperature. The construction carries a guide means operatively associated with the resilient contact member to provide a guide for the resilient contact member that will substantially insure that the resilient contact member will move and be maintained out of contact with the stationary contact member after the temperature sensitive member has been rendered non-solid. The guide means comprises a spring engaging and acting on the resilient contact member to tend to pull the resilient contact member out of contact with the stationary contact member.

Thus, it is an object of this invention to provide an improved thermally actuatable electrical switch construction having one or more of the novel features of this invention as set forth above or hereinafter shown or described.

Another object of this invention is to provide an improved method of making such a thermally actuatable electrical switch construction, the method of this invention having one or more of the novel features of this invention as set forth above or hereinafter shown or described.

Other objects, uses and advantages of this invention are apparent from a reading of this description which proceeds with reference to the accompanying drawings forming a part thereof and wherein:

DESCRIPTION OF THE PREFERRED EMBODIMENTS

Figure 1:
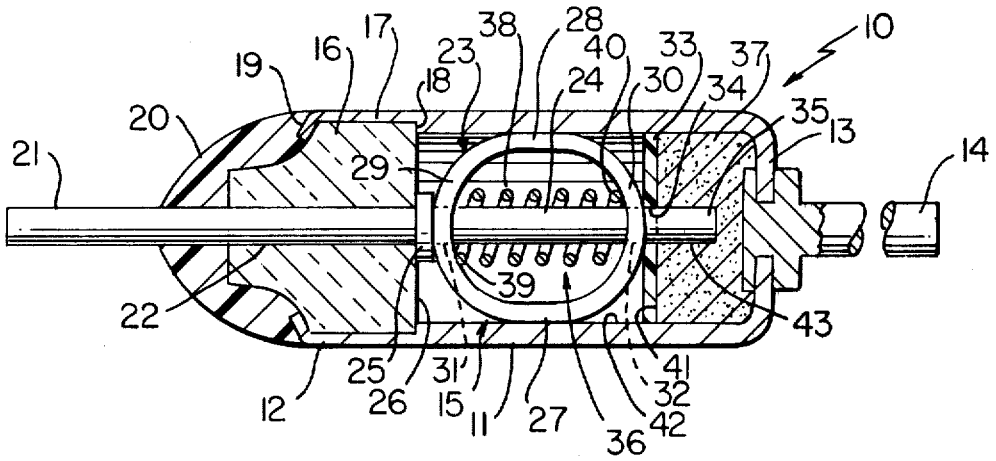
FIG. 1 is a cross-sectional view of one embodiment of the thermally actuatable electrical switch construction of this invention.

While the various features of this invention are hereinafter described and illustrated as being particularly adapted to provide a thermally actuatable electrical switch construction, it is to be understood that the various features of this invention can be utilized singly or in any combination thereof to provide other types of electrical switch constructions as desired.

Therefore, this invention is not to be limited to only the embodiments illustrated in the drawings, because the drawings are merely utilized to illustrate one of the wide variety of uses of this invention.

Referring now to FIG. 1, an improved thermally actuatable electrical switch construction of this invention is generally indicated by the reference numeral 10 and comprises an open ended conductive casing 11 having an open end 12 and a closed end 13, the closed end 13 of the casing 11 having an external conductive lead or terminal 14 secured thereto in any suitable manner so as to be electrically interconnected to the casing 11.

A sub-assembly of this invention for the thermally actuatable switch construction 10 is generally indicated by the reference numeral 15 in FIG. 3 and comprises an insulated end plug 16 of ceramic material or the like adapted to be received in a counter bore 17 in the open end 12 of the casing 11 in a manner hereinafter described to abut against an internal shoulder 18 thereof whereby the left-hand end 19 of the casing 11 can be turned over to secure the end plug 16 within the open end 12 of the casing 11 as illustrated in FIG. 1 and thereby close the open end 12 which is adapted to be further sealed closed by an epoxy resin sealing means 20 in a manner well known in the art.

The end plug 16 of the sub-assembly 15 has an electrically conductive lead or terminal 21 disposed through an opening 22 thereof in a manner to be press-fitted therein or otherwise secured thereto so that the end plug 16 and lead 21 are self-contained and can be inserted in the open end 12 of the casing 11 as a sub-assembly in a manner hereinafter described.

The lead or terminal 21 carries a resilient contact member that is generally indicated by the reference numeral 23 and is carried on an extension or stem means 24 of the terminal or lead 21 at a point located beyond an arresting head 25 thereof that engages against an end wall 26 of the end plug 16 as illustrated in FIG. 1. If desired, the stem means 24 can be integral and one-piece with the terminal 21 or be separate therefrom and be of any suitable electrically insulating or conductive material.

Figure 2:
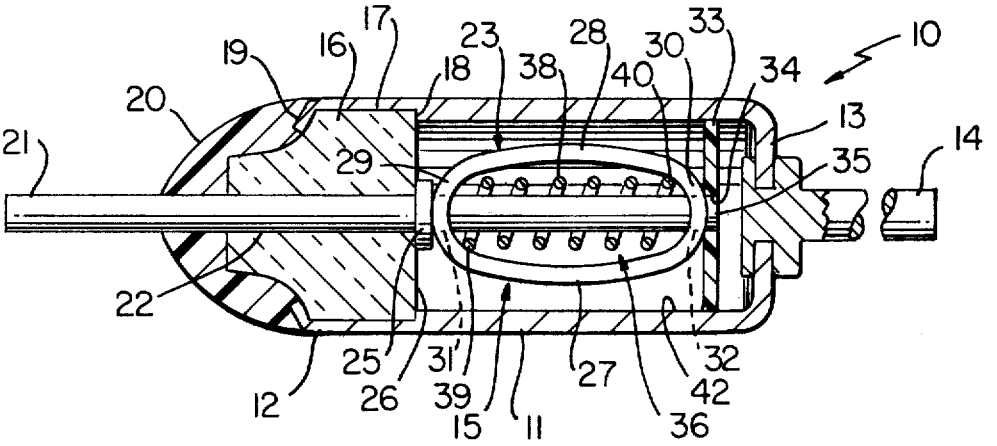
FIG. 2 is a view similar to FIG. 1 and illustrates the thermally actuatable electrical switch construction of FIG. 1 after the same has been thermally actuated.

The resilient contact member 23 comprises an annular conductive ribbon or strip disposed in annular form and thereby having two pairs of opposed parts 27, 28 and 29, 30 integrally interconnected together and having a normal bias that tends to elongate by having the parts 27 and 28 normally disposed closer together than the opposed parts 29 and 30 so that the resilient contact member 23 normally tends to be disposed in the oval or eliptical configuration illustrated in FIG. 2.

The parts 29 and 30 of the resilient contact member 23 respectively have aligned openings 31 and 32 passing therethrough and respectively receive the stem means 24 of the terminal 21 therethrough so that the resilient contact member 23 will be carried on the terminal 21 to form part of the subassembly 15, at least the opening 32 of the part 30 loosely receiving the stem means 24 therein so the part 30 can be movable relative thereto for a purpose that will be readily apparent hereinafter.

If desired, a non-conductive disc-like member or force spreader 33 can also be provided and has a central opening 34 passing therethrough so that the force spreader 33 can be telescoped onto the stem means 24 outboard of the contact member 23 as illustrated and be movable relative to the stem means 24.

If desired, the free end 35 of the stem means 24 could be turned over after the contact member 23 and force spreader 33 have been assembled thereon to capture the force spreader 33 thereon so that the same will not be shoved off of the free end 35 by the contact member 23. Thus, the force spreader 33 forms part of the self-contained sub-assembly 15 for insertion as a unit into the open end 12 of the casing 11 during the assembly of the thermally actuatable electrical switch construction 10 of this invention by the method of this invention in the manner hereinafter set forth.

Figure 3:
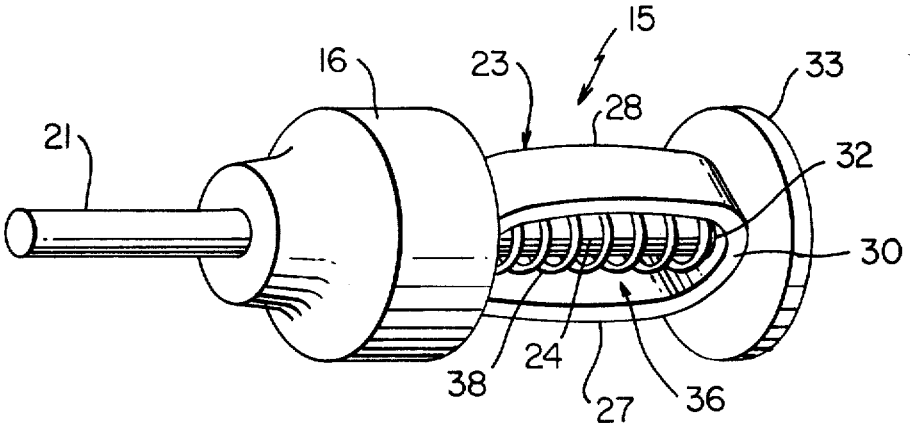
FIG. 3 is a perspective view of a sub-assembly part of the thermally actuatable electrical switch construction of FIGS. 1 and 2.

A separate guide means that is generally indicated by the reference numeral 36 in FIGS. 1–3 forms part of the sub-assembly 15 for substantially insuring that the resilient contact member 23 will assume the oval condition illustrated in FIG. 2 when a temperature sensitive element or pellet 37 of the thermally actuatable switch construction 10 is rendered non-solid by sensing a temperature above a predetermined temperature in a manner well known in the art.

The guide means 36 of this invention comprises a coiled compression spring 38 having opposed ends 39 and 40 and is telescoped on the stem means 24 so as to be positioned inside the annular resilient contact member 23 and have its opposed ends 39 and 40 respectively bearing and acting against the parts 29 and 30 of the resilient contact member 23 so that the compression spring 38 is always disposed under compression between the opposed parts 29 and 30 of the resilient contact member 23.

In this manner, the compression spring 38 will always tend to maintain the resilient contact member 23 in the oval condition as illustrated in FIG. 2 even if the natural resiliency of the contact means 23 ceases to tend to self-shape the same into the oval condition illustrated in FIG. 2 or even if the contact member 23 never had a natural bias to return to the oval condition illustrated in FIG. 2 as will be apparent hereinafter.

In any event, when it is desired to form the thermally actuatable electrical switch construction 10 of this invention, the thermal pellet 37 of the desired rating is first disposed in the open end 12 of the casing 11 to be disposed against the closed end 13 thereof.

Thereafter, the preformed sub-assembly 15 comprising the end plug 16, terminal 21, stem means 24, contact 23, spring 38 and force spreader 33 is inserted into the open end 12 of the casing 11 until the force spreader 33 makes contact with the side or end 41 of the pellet 37 whereby further insertion of the sub-assembly 15 into the casing 11 causes the end plug 16 to be moved toward the now stationary force spreader 33 so that the resilient contact member 23 is being compressed between the force spreader 33 and the arresting head 25 of the terminal 21 to cause the parts 27 and 28 thereof to be forced or biased outwardly and into electrical contact with the inside surface 42 of the conductive casing 11 in the manner illustrated in FIG. 1 at which time the end plug 16 bottoms out against the shoulder 18 of the casing 11. The end 19 of the casing 11 is then turned over the end plug 16 to secure the same in the position illustrated in FIG. 1 and the epoxy resin material 20 can be disposed over the end plug 16 and terminal 21 to seal close the opening 22 of the end plug 16 as well as to provide an insulating barrier on the projecting portion of the terminal 21 to space the exposed conductive portion of the terminal 21 from the casing 11 as is well known in the art.

During the inserting of the sub-assembly 15 into the casing 11 in the manner previously described, the end 35 of the stem means 24 could form its own opening 43 into the pellet 37 or such opening 43 could have been originally formed therein before the pellet 37 was disposed in the casing 11.

In any event, it can be seen that after the subassembly 15 has been assembled into the casing 11 to form the thermally actuatable electrical switch construction 10 of this invention as illustrated in FIG. 1, a conductive path is provided between the terminals 14 and 21 by the resilient contact member 23 having the parts 28 and 27 thereof disposed in contact with the inside surface 42 of the casing 11 with the resilient contact member 23 being in contact with the terminal 21 by having at least the part 29 thereof held into electrical contact with the arresting head 25 should the stem means 24 be formed of electrical insulating material.

However, when the temperature sensitive member 37 senses a temperature above the rated temperature thereof, the pellet 37 collapses and, thus, becomes non-solid in a manner well known in the art whereby it is believed that the natural resiliency of the resilient contact member 23 will tend to cause the parts 29 and 30 thereof to move away from each other and thereby elongate to pull the parts 27 and 28 toward each other and, thus, out of contact with the inside surface 42 of the casing 11 in the manner illustrated in FIG. 2. In this manner, the electrical circuit between the terminals 14 and 21 is terminated by the thermally actuated electrical switch construction 10 of this invention.

As previously stated, it is believed that the compression spring 38 will substantially insure that the resilient contact member 23 will assume the oval shape illustrated in FIG. 2 when the thermal pellet 37 is rendered non-solid because the force of the compression spring 38 is such that the same will tend to drive the part 30 of the resilient contact member 23 on the stem means 24 away from the part 29 thereof and, thus, pull the parts 27 and 28 toward each other and out of contact with the inside surface 42 of the casing 11 as illustrated in FIG. 2.

Thus, it can be seen that during the thermal actuation of the thermally actuatable switch construction 10 of this invention, it is believed that not only will the natural bias of the resilient contact member 23 tend to pull the parts 27 and 28 thereof out of contact with the inside surface 42 of the casing 11 to interrupt and terminate the electrical circuit between the terminals 14 and 21 thereof, but also the compression spring 38 will drive the parts 29 and 30 of the resilient contact member 23 away from each other so as to elongate the annular contact member 23 and thereby pull the parts 27 and 28 toward each other out of contact with the inside surface 42 of the casing 11, the stem 24 also guiding the elongating movement of the resilient contact member 23 into the oval condition illustrated in FIG. 2 when the temperature sensitive member 37 is rendered non-solid by sensing a temperature above the predetermined rated temperature thereof in a manner well known in the art.

While the switch construction 10 previously described utilizes the stem portion 24 for also guiding the movement of the resilient contact member 23 into its elongated condition, it is believed that the stem portion 24 could be eliminated and that the compression spring 38 would still perform its guiding function without the use of the stem means 24. Also, the force spreader 33 could be eliminated, if desired.

Figure 4:
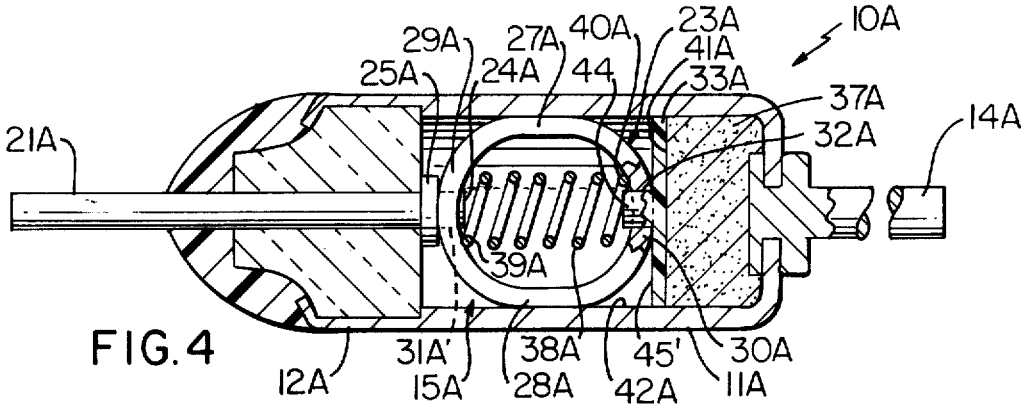
FIG. 4 is a view similar to FIG. 1 and illustrates another embodiment of the thermally actuatable switch construction of this invention.
Figure 5:
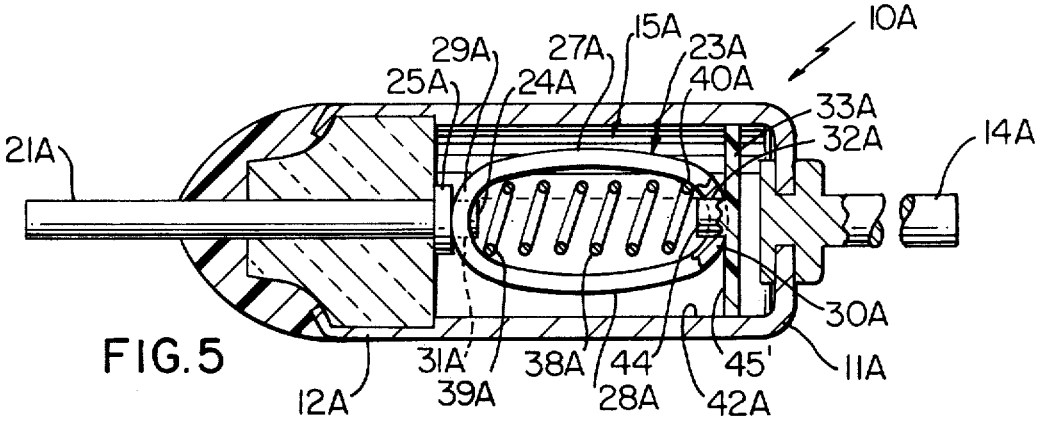
FIG. 5 is a view similar to FIG. 4 and illustrates the thermally actuatable electrical switch construction of FIG. 4 after the same has been thermally actuated.

Another thermally actuatable electrical switch construction of this invention is generally indicated by the reference numeral 10A in FIGS. 4 and 5 and parts thereof similar to the thermally actuatable switch construction 10 previously described are indicated by like reference numerals followed by the reference letter "A".

As illustrated in FIG. 4, the terminal 21A has a very short stem means 24A extending from the arresting head 25A thereof to be telescopically received in the opening 31A in the part 29A of the resilient contact member 23A.

The non-conductive force spreader 33A of the switch construction 10A has an integral stem means 44 extending from the side 45' thereof to be telescopically received in the opening 32A in the part 30A of the resilient contact member 23A so that the stem means 44 will move in unison with the force spreader 33A when the same is moved to the right in the drawings upon the temperature sensitive member 37A being rendered non-solid.

If desired, the stem means 24A and 44 can be of sufficient lengths so that parts thereof will respectively telescope within the opposed ends 39A and 40A of the compression spring 38A which is disposed in the annular contact member 23A to guide the same into the oval shape illustrated in FIG. 5 when the thermal pellet 37A is rendered non-solid by sensing a temperature above the rated temperature thereof as previously described.

Further, the stem 44 of the force spreader 33A could be force fitted into the opening 32A of the resilient contact member 23A so that the same will be carried thereby in the self-contained sub-assembly 15A which is subsequently inserted into the casing 11A after the pellet 37A has been disposed therein during the assembly of the electrical switch construction 10A of this invention as previously described.

Thus, it can be seen that when the sub-assembly 15A is inserted into the open end 12A of the casing 11A and the force spreader 33A abuts against the side or end 41A of the pellet 37A, the parts 29A and 30A of the resilient contact member 23A begin to be compressed toward each other so that the parts 27A and 28A will be biased outwardly into contact with the inside surface 42A of the casing 11A in the manner illustrated in FIG. 4 to provide electrical connection between the terminals 14A and 21A in the manner previously described.

However, when the temperature sensitive member 37A is rendered non-solid by sensing a temperature above its predetermined temperature, it is believed that not only will the natural bias of the resilient contact member 23A tend to move into the oval condition illustrated in FIG. 5 and thereby pull the parts 27A and 28A out of contact with the inside surface 42A of the casing 11A in the manner previously described, but also the compression spring 38A will drive the part 30A away from the part 29A to insure the elongation thereof and, thus, the pulling in of the parts 27A and 28A of the contact member 23A out of contact with the surface 42A of the casing 11A as previously described.

Figure 6:
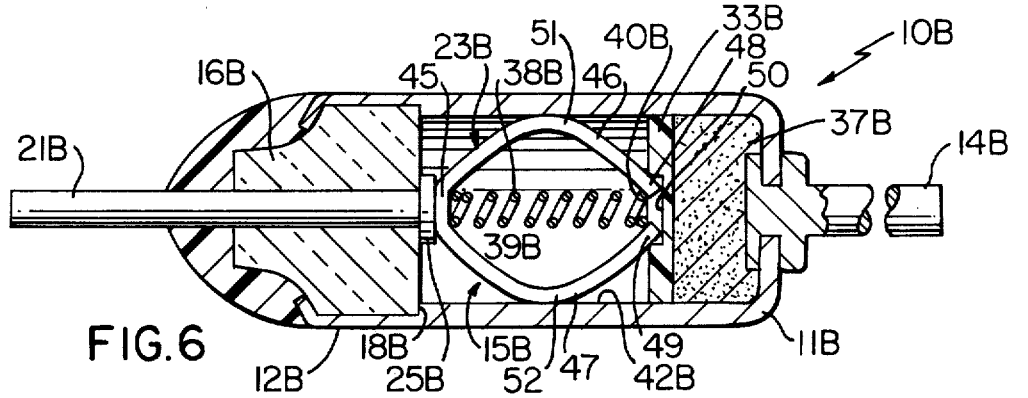
FIG. 6 is a view similar to FIG. 1 and illustrates another embodiment of the thermally actuatable electrical switch construction of this invention.
Figure 7:
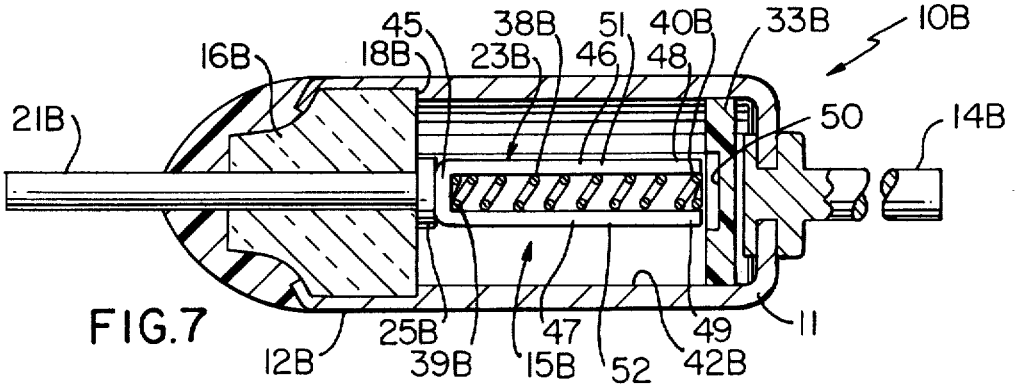
FIG. 7 is a view similar to FIG. 6 and illustrates the thermally actuatable electrical switch construction of FIG. 6 after the same has been thermally actuated.

Another thermally actuatable electrical switch construction of this invention is generally indicated by the reference numeral 10B in FIGS. 6 and 7 and parts thereof similar to the other thermally actuatable electrical switch constructions 10 and 10A of this invention are indicated by like reference numerals followed by the reference letter "B".

As illustrated in FIG. 6, the resilient contact member 23B has a normal bias to return to a U-shape as illustrated in FIG. 7 as defined by a cross member 45 that is secured by riveting, welding or other suitable means, to the arresting head 25B of the terminal 21B while the two legs 46 and 47 thereof normally tend to be disposed substantially straight and parallel to each other and respectively at right angles to the cross member 45 as illustrated in FIG. 7.

If desired, a guide compression spring 38B can be disposed between the legs 46 and 47 of the contact member 23B and have its end 39B bear against the cross-member 45 while its end 40B is secured by welding or the like to the free ends 48 and 49 of the legs 46 and 47.

When the sub-assembly 15B comprising the insulating plug 16B, terminal 21B, resilient contact means 23B and spring 38B is inserted into the open 12B of the casing 11B, the free ends 48 and 49 of the legs 46 and 47 make contact with a recessed surface 50 of the force spreader 33B and thereby have the intermediate parts 51 and 52 thereof bowed outwardly into contact with the inside surface 42B of the casing 11B when the end plug 16B bottoms out against the shoulder 18B of the casing 11B as illustrated in FIG. 5. Thus, as long as the temperature sensitive member 37B remains solid, an electrical connection is completed through the device 10B between the terminals 14B and 21B by the resilient contact member 23B.

When the temperature sensitive member 37B is rendered non-solid by sensing a temperature above the rated temperature thereof, the collapsing of the pellet 37B permits the natural resiliency of the legs 46 and 47 of the resilient contact member 23B to spring back to their normal parallel shape illustrated in FIG. 7 and thereby pull the intermediate parts 51 and 52 thereof out of contact with the inside surface 42B of the casing 11B and thereby terminate the electrical connection between the terminals 14B and 21B through the thermally actuatable switch construction 10B of this invention. Of course, the spring 38B substantially insures that the legs 46 and 47 will assume the shape illustrated in FIG. 7 for the reasons previously set forth.

Thus, it can be seen that this invention not only provides an improved thermally actuatable electrical switch construction, but also this invention provides an improved method of making such a switch construction or the like.

While the forms and methods of this invention, now preferred, have been illustrated and described as required by the Patent Statute, it is to be understood that other forms and method steps can be utilized and still fall within the scope of the appended claims.

What is claimed is:

1. In a thermally actuatable electrical switch construction having a resilient contact member normally biased into electrical contact with a stationary contact member while a temperature sensitive member of said construction is in a solid condition and normally tending to spring out of contact with said stationary contact member by the natural bias of said resilient contact member when said temperature sensitive member is rendered non-solid by sensing a temperature above a predetermined temperature, said construction carrying guide means operatively associated with said resilient contact member to provide a guide for said resilient contact member that will substantially insure that said resilient contact member will move and be maintained out of contact with said stationary contact member after said temperature sensitive member has been rendered non-solid, the improvement wherein said guide means comprises a spring engaging and acting on said resilient contact member to tend to pull said resilient contact member out of contact with said stationary contact member.

2. A thermally actuatable electrical switch construction as set forth in claim 1 wherein said spring comprises a compression spring having opposed ends respectively engaging said resilient contact member and being under compression between said opposed ends thereof.

3. A thermally actuatable electrical switch construction as set forth in claim 2 wherein said resilient contact member comprises an annular member, said spring being disposed inside said annular member and tending to elongate the same.

4. A thermally actuatable electrical switch construction as set forth in claim 1 wherein said stationary contact member comprises a conductive casing having an open end and an inside surface, an insulative plug disposed in said open end and closing the same, a conductive terminal member being carried by said plug and projecting into said casing, said resilient contact member being carried by said terminal member inside said casing whereby said resilient contact member is held into contact with said inside surface of said casing while said temperature sensitive member is solid.

5. A thermally actuatable electrical switch construction as set forth in claim 4 wherein said resilient contact member comprises an annular member having two pairs of opposed parts integrally interconnected together, one pair of said opposed parts making contact with said inside surface of said casing when said temperature sensitive member is solid.

6. A thermally actuatable electrical switch construction as set forth in claim 5 wherein said spring comprises a compression spring having opposed ends, said spring being disposed inside said annular member and having said opposed ends thereof acting against the other pair of opposed parts of said annular member to tend to elongate said annular member between said other pair of opposed parts thereof and thereby tend to pull said one pair of opposed parts thereof toward each other and out of contact with said inside surface of said casing.

7. A thermally actuatable electrical switch construction as set forth in claim 1 wherein said guide means includes a stem means carried by said construction, said resilient contact member having opening means therethrough receiving said stem means therein.

8. A thermally actuatable electrical switch construction as set forth in claim 7 wherein said stem means is stationary in said construction.

9. A thermally actuatable electrical switch construction as set forth in claim 7 wherein said stem means is movable in said construction and is moved by said resilient contact member when said temperature sensitive member is rendered non-solid.

10. A thermally actuatable electrical switch construction as set forth in claim 7 wherein said spring comprises a coiled compression spring having at least a part thereof telescoped on said stem means.

11. A thermally actuatable electrical switch construction as set forth in claim 7 wherein said stationary contact member comprises a conductive casing having an open end and an inside surface, an insulative plug disposed in said open end and closing the same, a conductive terminal member being carried by said plug and projecting into said casing, said resilient contact member being carried by said terminal member inside said casing whereby said resilient contact member is held into contact with said inside surface of said casing while said temperature sensitive member is solid.

12. A thermally actuatable electrical switch construction as set forth in claim 11 wherein said resilient contact member comprises an annular member having two pairs of opposed parts integrally interconnected together, one pair of said opposed parts making contact with said inside surface of said casing when said temperature sensitive member is solid.

13. A thermally actuatable electrical switch construction as set forth in claim 12 wherein said spring comprises a compression spring having opposed ends, said spring being disposed inside said annular member and having said opposed ends thereof acting against the other pair of opposed parts of said annular member to tend to elongate said annular member between said other pair of opposed parts thereof and thereby tend to pull said one pair of opposed parts thereof toward each other and out of contact with said inside surface of said casing.

14. A thermally actuatable electrical switch construction as set forth in claim 13 wherein said stem means is carried by said terminal member and is substantially coaxial therewith, said other pair of opposed parts of said annular member having aligned openings passing therethrough and loosely receiving said stem means therethrough, said spring being telescoped on said stem means.

15. A thermally actuatable electrical switch construction as set forth in claim 13 wherein said stem means has a disc-like member disclosed closely adjacent said inside surface of said casing and being movable relative thereto, one of said parts of said other pair of parts of said annular member having an opening therethrough receiving said stem means therein, said spring having a part thereof telescoped on said stem means.

16. In a method of making a thermally actuatable electrical switch construction having a resilient contact member normally biased into electrical contact with a stationary contact member while a temperature sensitive member of said construction is in a solid condition and normally tending to spring out of contact with said stationary contact member by the natural bias of said resilient contact member when said temperature sensitive member is rendered non-solid by sensing a temperature above a predetermined temperature, said construction carrying guide means operatively associated with said resilient contact member to provide a guide for said resilient contact member that will substantially insure that said resilient contact member will move and be maintained out of contact with said stationary contact member after said temperature sensitive member has been rendered non-solid, the improvement comprising the step of forming said guide means to comprise a spring that engages and acts on said resilient contact member to tend to pull said resilient contact member out of contact with said stationary contact member.

17. A method of making a thermally actuatable electrical switch construction as set forth in claim 16 and including the step of forming said spring to comprise a compression spring having opposed ends respectively engaging said resilient contact member and be under compression between said opposed ends thereof.

18. A method of making a thermally actuatable electrical switch construction as set forth in claim 17 and including the steps of forming said resilient contact member to comprise an annular member, and disposing said spring inside said annular member to tend to elongate the same.

19. A method of making a thermally actuatable electrical switch construction as set forth in claim 16 and including the steps of forming said stationary contact member to comprise a conductive casing having an open end and an inside surface, disposing an insulative plug in said open end to close the same, forming a conductive terminal member to be carried by said plug and project into said casing, and forming said resilient contact member to be carried by said terminal member inside said casing whereby said resilient contact member is held into contact with said inside surface of said casing while said temperature sensitive member is solid.

20. A method of making a thermally actuatable electrical switch construction as set forth in claim 19 and including the steps of forming said resilient contact member to comprise an annular member having two pairs of opposed parts integrally interconnected together, and causing one pair of said opposed parts to make contact with said inside surface of said casing when said temperature sensitive member is solid.

21. A method of making a thermally actuatable electrical switch construction as set forth in claim 20 and including the steps of forming said spring to comprise a compression spring having opposed ends, and disposing said spring inside said annular member to have said opposed ends thereof act against the other pair of opposed parts of said annular member to tend to elongate said annular member between said other pair of opposed parts thereof and thereby tend to pull said one pair of opposed parts thereof toward each other and out of contact with said inside surface of said casing.

22. A method of making a thermally actuatable electrical switch construction as set forth in claim 16 and including the steps of forming said guide means to include a stem means carried by said construction, and forming said resilient contact member to have opening means therethrough receiving said stem means therein.

23. A method of making a thermally actuatable electrical switch construction as set forth in claim 22 and including the step of forming said stem means to be stationary in said construction.

24. A method of making a thermally actuatable electrical switch construction as set forth in claim 22 and including the step of forming said stem means to be movable in said construction and to be moved by said resilient contact member when said temperature sensitive member is rendered non-solid.

25. A method of making a thermally actuatable electrical switch construction as set forth in claim 22 and including the step of forming said spring to comprise a coiled compression spring having at least a part thereof telescoped on said stem means.

26. A method of making a thermally actuatable electrical switch construction as set forth in claim 22 and including the steps of forming said stationary contact member to comprise a conductive casing having an open end and an inside surface, disposing an insulative plug in said open end to close the same, forming a conductive terminal member to be carried by said plug and project into said casing, and forming said resilient contact member to be carried by said terminal member inside said casing whereby said resilient contact member is held into contact with said inside surface of said casing while said temperature sensitive member is solid.

27. A method of making a thermally actuatable electrical switch construction as set forth in claim 26 and including the steps of forming said resilient contact member to comprise an annular member having two pairs of opposed parts integrally interconnected together, and causing one pair of said opposed parts to make contact with said inside surface of said casing when said temperature sensitive member is solid.

28. A method of making a thermally actuatable electrical switch construction as set forth in claim 27 and including the steps of forming said spring to comprise a compression spring having opposed ends, and disposing said spring inside said annular member and have said opposed ends thereof act against the other pair of opposed parts of said annular member to tend to elongate said annular member between said other pair of opposed parts thereof and thereby tend to pull said one pair of opposed parts thereof toward each other and out of contact with said inside surface of said casing.

29. A method of making a thermally actuatable electrical switch construction as set forth in claim 28 and including the steps of forming said stem means to be carried by said terminal member and be substantially coaxial therewith, forming said other pair of opposed parts of said annular member to have aligned openings passing therethrough and loosely receiving said stem means therethrough, and telescoping said spring on said stem means.

30. A method of making a thermally actuatable electrical switch construction as set forth in claim 28 and including the steps of forming said stem means to have a disc-like member disposed closely adjacent said inside surface of said casing and be movable relative thereto, forming one of said parts of said other pair of parts of said annular member to have an opening therethrough receiving said stem means therein, and telescoping part of said spring on said stem means.

31. A thermally actuatable electrical switch construction as set forth in claim 14 wherein said stem means is integral with said terminal member whereby said terminal member and said stem means comprise a one-piece member.

32. A thermally actuatable electrical switch construction as set forth in claim 31 wherein said one-piece member has an enlarged head engaging said insulative plug intermediate said insulative plug and said resilient contact member.

33. A method of making a thermally actuatable electrical switch construction as set forth in claim 29 and including the step of forming said stem means to be integral with said terminal member whereby said terminal member and said stem means comprise a one-piece member.

34. A method of making a thermally actuatable electrical switch construction as set forth in claim 33 and including the steps of forming said one-piece member to have an enlarged head, disposing said head intermediate said insulative plug and said resilient contact member, and engaging said head against said insulative plug.

* * * * *